US010088203B2

(12) United States Patent
Kirkconnell et al.

(10) Patent No.: US 10,088,203 B2
(45) Date of Patent: Oct. 2, 2018

(54) HIGH EFFICIENCY COMPACT LINEAR CRYOCOOLER

(75) Inventors: Carl S. Kirkconnell, Huntington Beach, CA (US); Michael C. Barr, Torrance, CA (US); Lowell A. Bellis, Long Beach, CA (US)

(73) Assignee: Raytheon Company, Waltham, MA (US)

( * ) Notice: Subject to any disclaimer, the term of this patent is extended or adjusted under 35 U.S.C. 154(b) by 1717 days.

(21) Appl. No.: 12/483,319

(22) Filed: Jun. 12, 2009

(65) Prior Publication Data

US 2010/0313577 A1 Dec. 16, 2010

(51) Int. Cl.

| | |
|---|---|
| ***F25B 9/00*** | (2006.01) |
| ***F25B 9/14*** | (2006.01) |
| *F04B 53/08* | (2006.01) |

(52) U.S. Cl.

CPC ..... *F25B 9/14* (2013.01); *F04B 53/08* (2013.01); *F25B 9/145* (2013.01); *F25B 2309/001* (2013.01); *F25B 2309/003* (2013.01); *F25B 2400/071* (2013.01)

(58) Field of Classification Search

CPC ..... F25B 2400/071; F25B 2400/073; F25B 9/14; F04B 53/08; F04B 2205/11; F04B 2205/111; F04B 2205/112; F02G 1/043; F02G 1/047

USPC ..... 62/6, 600; 417/437, 340, 496

See application file for complete search history.

(56) References Cited

U.S. PATENT DOCUMENTS

| | | | | |
|---|---|---|---|---|
| 1,730,580 | A | 10/1929 | Lundgaard | |
| 3,220,178 | A | 11/1965 | Dineen | |
| 3,650,118 | A * | 3/1972 | O'Neil | 62/6 |
| 4,372,128 | A | 2/1983 | Sarcia | |
| 4,553,398 | A * | 11/1985 | Young | 62/6 |
| 5,647,217 | A * | 7/1997 | Penswick et al. | 62/6 |
| 6,327,862 | B1 * | 12/2001 | Hanes | F25B 9/14 62/51.2 |
| 6,347,524 | B1 * | 2/2002 | Barrash et al. | 62/6 |
| 7,062,922 | B1 * | 6/2006 | Kirkconnell et al. | 62/6 |

(Continued)

FOREIGN PATENT DOCUMENTS

| | | |
|---|---|---|
| EP | 0 073 115 A1 | 3/1983 |
| EP | 1538406 | 6/2005 |

(Continued)

OTHER PUBLICATIONS

Intl. Preliminary Report on Patentability dated Nov. 16, 2011 of PCT/US2010/024190 filed Feb. 12, 2010 (8 pages).

(Continued)

*Primary Examiner* — Frantz Jules
*Assistant Examiner* — Webeshet Mengesha

(57) ABSTRACT

A method of removing heat due to compression of a working gas from a linear cryocooler is disclosed. The cryocooler includes a sealed housing, a displacer including a displacer piston and a displacer cylinder, and a compressor all arranged within the housing. The compressor includes a compressor piston that is movable within a compression chamber. The method includes providing a port in the compression chamber to remove heat from the compression chamber due to the compression of the working gas to the housing prior to entering the displacer piston.

20 Claims, 6 Drawing Sheets

(56) References Cited

U.S. PATENT DOCUMENTS

| | | | | |
|---|---|---|---|---|
| 2003/0221427 | A1* | 12/2003 | O'baid | F02G 1/053 60/517 |
| 2004/0182077 | A1* | 9/2004 | O'Baid et al. | 60/520 |
| 2005/0120721 | A1* | 6/2005 | O'Baid et al. | 62/6 |
| 2005/0166602 | A1* | 8/2005 | Park | F25B 9/14 62/6 |
| 2007/0056297 | A1* | 3/2007 | Price et al. | 62/6 |
| 2008/0282706 | A1 | 11/2008 | Hon et al. | |
| 2008/0282708 | A1 | 11/2008 | Bellis et al. | |
| 2009/0217658 | A1* | 9/2009 | Fiedler | F25B 9/14 60/519 |

FOREIGN PATENT DOCUMENTS

| | | | |
|---|---|---|---|
| EP | 1562008 | | 8/2005 |
| GB | 1340080 | A | 12/1973 |
| WO | WO 01/81840 | | 11/2001 |
| WO | WO 2005/121658 | | 12/2005 |

OTHER PUBLICATIONS

PCT/US2010/024190 filed Feb. 12, 2010, Intl. Search Report/Written Opinion dated Jan. 11, 2011 (12 pages).
European Office Action issued for 10722804.1 dated Jan. 14, 2016, 6 pgs.

* cited by examiner

HIGH EFFICIENCY COMPACT LINEAR CRYOCOOLER

BACKGROUND

This disclosure relates generally to the field of cryocoolers and, more specifically, to the construction and arrangement of a linear cryocooler.

For certain applications, such as space infrared sensor systems, a cryogenic cooling subsystem is required to achieve improved sensor performance. Numerous types of cryogenic cooling subsystems are known in the art, each having a relatively strong attributes relative to the other types. Stirling and pulse-tube linear cryocoolers are typically used to cool various sensors and focal plane array in military, commercial and laboratory applications. Both type of cryocoolers use a linear-oscillating compressor to convert electrical power to thermodynamic pressure-volume (PV).

A conventional reciprocating cryogenic refrigerator, such as a Stirling-cycle cryocooler, has a single working volume that is utilized by both a compressor and displacer. The most common implementation features physically distinct compressor and displacer subassemblies, which may be mounted within a single housing or split into two modules connected by a transfer line. Another approach is to concentrically arrange the compressor and displacer movable parts. One of the parts may be a cylindrical piston, a portion of which moves within a central bore or opening in a cylinder that is the other moving part. The piston may be a component of the compressor and the cylinder, a component of the displacer, or vice versa. The dynamic working volume, which is that portion of the working volume that is varied based upon the motion of the moveable parts, is located, in part, in a bore of the cylinder, between the piston and a regenerator that is coupled to the moveable cylinder. Additional dynamic working volume is located at the end of the Stirling displacer. Movement of either the piston or the cylinder can cause compression or expansion of the working gas in either or both of the dynamic volumes. Proper phasing of these expansion and compression processes between the volumes is what generates refrigeration. Seals (tight clearance gap, sliding, etc.) are maintained between the piston, the cylinder, and the fixed housing that contains them to minimize leakage between the working gas and the plenum gas while still allowing for free movement of the piston and the cylinder. The arrangement in which the compressor and the displacer are concentric to each other allows for placement of these mechanisms into a single, compact housing, which in turn reduces the size and mass of the cryocooler in comparison to a two-module design.

However, these conventional approaches often involve difficult thermal paths from the compression chamber to a heat sink to complete the thermodynamic cycle, resulting in reduced thermodynamic efficiency and potential catastrophic failure due to thermal expansion induced contact between moving surfaces.

What is needed is a thermal-cycle cryocooler with an improved thermal path and increased thermodynamic efficiency that overcomes the above-identified deficiencies.

SUMMARY

In accordance with various embodiments of this disclosure, a method of removing heat due to compression of a working gas from a linear cryocooler is disclosed. The cryocooler includes a sealed housing, a displacer including a displacer piston and a displacer cylinder, and a compressor all arranged within the housing, the compressor having a compressor piston that is movable within a compression chamber, the method comprising: providing a port in the compression chamber to remove heat from the compression chamber due to the compression of the working gas to the housing prior to entering the displacer piston.

In accordance with various embodiments of this disclosure, a linear cryocooler, is disclosed that comprises a sealed housing configured to house a compressor and a displacer having a displacer piston operable to move within a displacer cylinder; the compressor including a compressor piston that is movable within a compression chamber, wherein the compression chamber includes a port, wherein the port is configured to allow rejection of heat due to compression of a working gas by the compressor directly through the sealed housing.

These and other features and characteristics, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various Figures. It is to be expressly understood, however, that the drawings are for the purpose of illustration and description only and are not intended as a definition of the limits of claims. As used in the specification and in the claims, the singular form of "a", "an", and "the" include plural referents unless the context clearly dictates otherwise.

DETAILED DESCRIPTION

Figure 1:
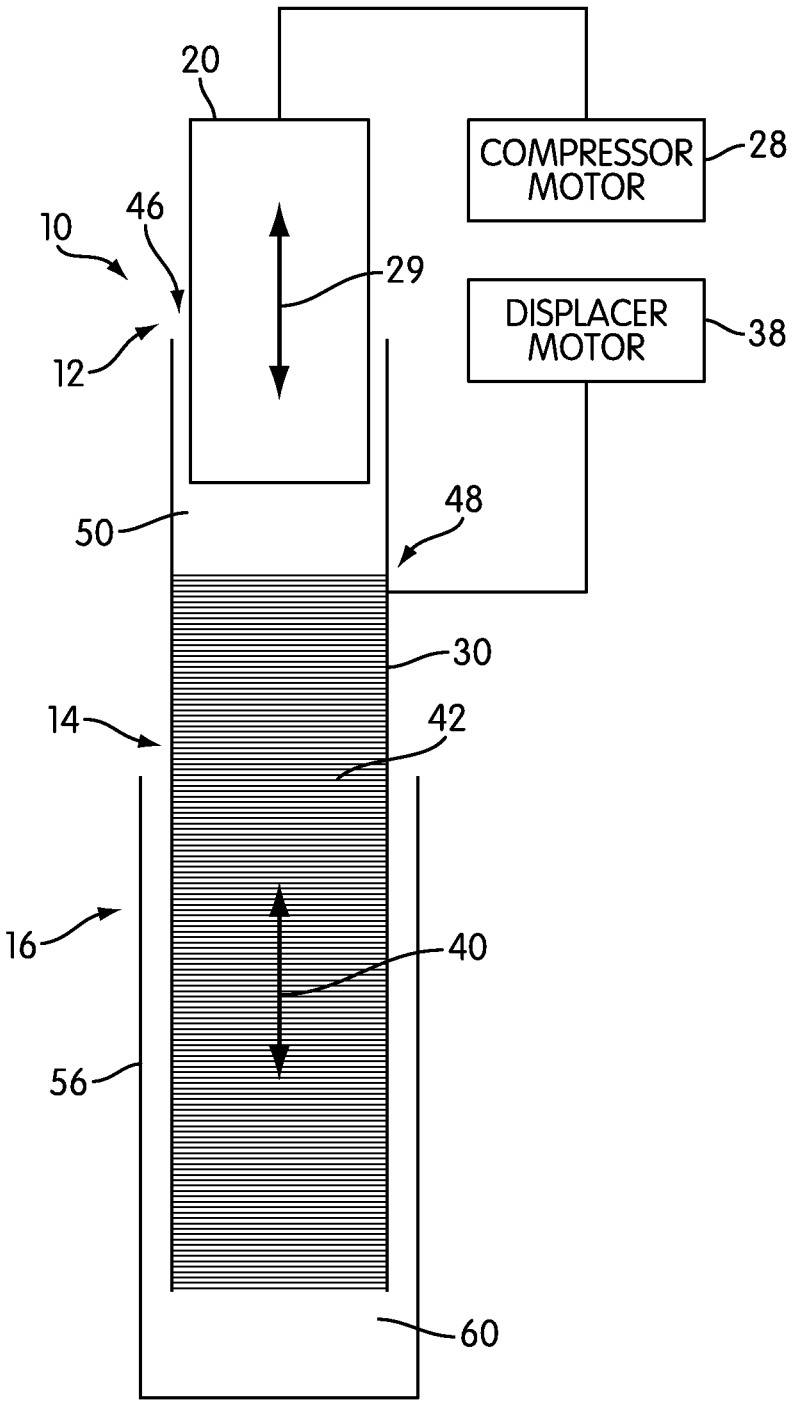
FIG. 1 shows a schematic view of a related cryocooler.

In the description that follows, like components have been given the same reference numerals, regardless of whether they are shown in different embodiments. To illustrate an embodiment(s) of the present disclosure in a clear and concise manner, the drawings may not necessarily be to scale and certain features may be shown in somewhat schematic form. Features that are described and/or illustrated with respect to one embodiment may be used in the same way or in a similar way in one or more other embodiments and/or in combination with or instead of the features of the other embodiments.

The present disclosure will be described in the context of improving efficiency of a Stirling class cryocooler used to cool optical components and sensors of a spacecraft. For example, the cooled devices can be an actively cooled cryogenic infrared (IR) sensor, an optical instrument, a focal plane or similar item. It will be appreciated, however, that the cooled item can be any item in need of cryogenic cooling.

FIG. 1 shows a related compact cryocooler, indicated generally at 10. The related compact cryocooler 10 has a compact size and is light weight. Moreover, the compact design enables the use of simplified electronics relative to other conventional split module linear cryocoolers by virtue of the reduction in the number of motors from at least four (two compressor motors, a displacer motor, and an active balancer) to three (one compressor motor, a displacer motor, and an active balancer). However, as mentioned above, these designs suffered a thermodynamic efficiency penalty relative to other cryocoolers because the working gas in the compressor chamber was thermally isolated from the environmental heal sink.

Figure 2:
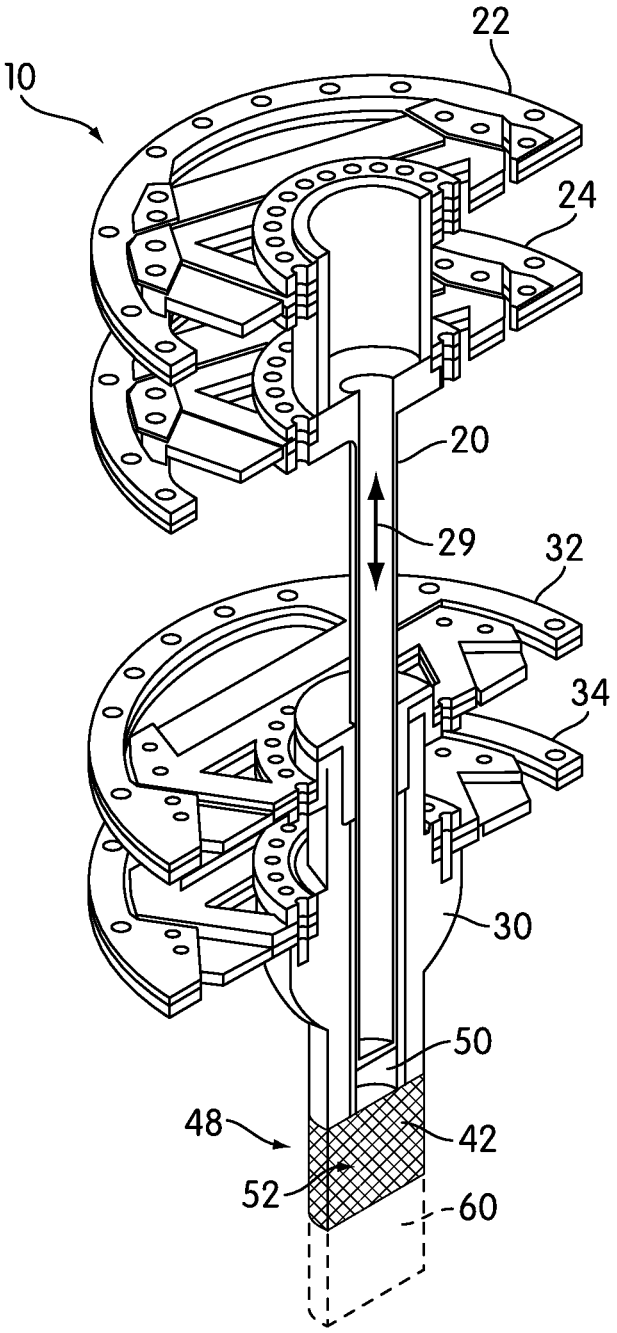
FIG. 2 shows an oblique cutaway view of a movable portion of the related cryocooler of FIG. 1.

Referring now to FIGS. 1 and 2, cryocooler 10 includes compressor 12 and displacer 14 inside hermetically sealed housing 16. Cryocooler 10 is a thermal cycle cryocooler, compressing and expanding the working gas, such as helium, hydrogen or air, in a thermodynamic cycle. An example of a suitable thermal cycle is a Stirling cycle, though many other types of thermal cycles are well known. A Stirling cycle is a thermal cycle that progresses through successive steps of isothermal compression, isochoric (constant volume) cooling, isothermal expansion, and isochoric heating. Cryocooler 10 thus may be a Stirling cycle cryocooler.

Compressor 12 includes compressor piston 20 and a pair of compressor flexures 22 and 24. Movement of compressor piston 20 and compressor flexures 22 and 24 are controlled by compressor motor 28. Compressor flexures 22 and 24 are fixed at their outer ends to a suitable stationary structure within housing 16. Piston 20 is coupled to inner openings of compressor flexures 22 and 24. Compressor motor 28 is coupled to compressor piston 20 and/or to compressor flexures 22 and 24. Compressor motor 28 moves the compressor piston in linear direction 29. Compressor motor 28 can be any of a wide variety of suitable motor types, such as suitable electrical motors. Under the force of compressor motor 28, compressor piston 20 and the inner parts of compressor flexures 22 and 24 move in a linear fashion.

Displacer 14 includes displacer cylinder 30, a pair of displacer flexures 32 and 34, and displacer motor 38. The outer parts of flexures 32 and 34 are stationary relative to housing 16. The inner parts of displacer flexures 32 and 34 are attached to Stirling displacer cylinder 30, and move in a linear fashion along with displacer cylinder 30. The displacer is mechanically coupled to displacer cylinder 30 and/or to displacer flexures 32 and 34, in order to move displacer cylinder 30 up and down in linear direction 40. Regenerator 42 is coupled to displacer cylinder 30, and moves with displacer cylinder 30. Compressor piston 20 and displacer cylinder 30 have a suitable seal 46 between them.

Piston 20 and displacer 30 define between them unified compressor/displacer working volume 48. Compressor/displacer working volume 48 includes hot working volume 50 that is in bore 52 in cylinder 30.

Housing 16 includes housing portion 56 that defines cold working volume 60 between regenerator 42 and housing portion 56. Unified compressor/displacer working volume 48 includes hot working volume 50 and cold working volume 60, which are on opposite respective sides of regenerator 42, as well as the volume of working gas within regenerator 42.

Figure 3:
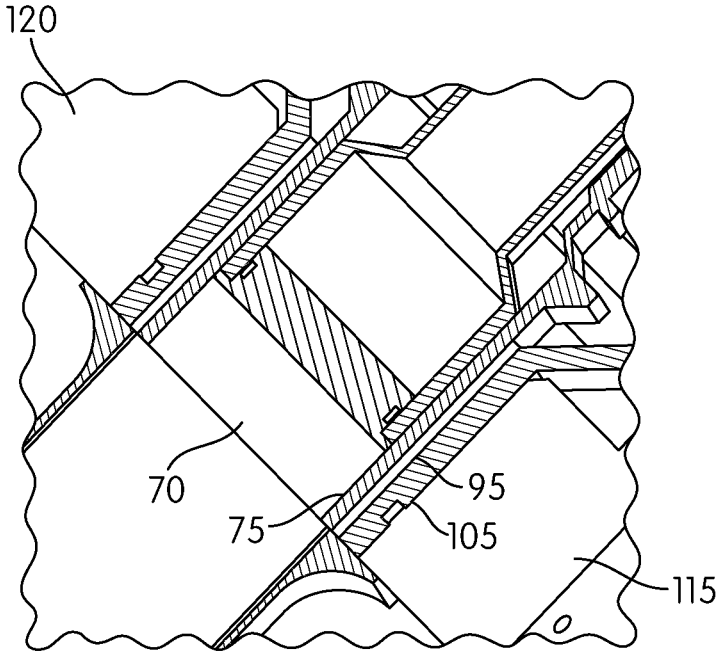
FIG. 3 shows a thermal path between the compressor chamber and the thermally isolated environmental heat sink of the related cryocooler of FIGS. 1 and 2.

FIG. 3 shows a thermal path between the compressor chamber and the thermally isolated environmental heat sink of the related cryocooler of FIGS. 1 and 2. The thermal path from the compression chamber to the heat is as follows:

1. convection from within compression chamber 70 to displacer piston wall 75 across a small annular surface area (not shown);
2. conduction through displacer piston wall 75, which is normally a low thermal conductivity metal alloy, such as stainless steel or titanium;
3. conduction/convection across gas gap (not shown) between a displacer piston (not shown) and displacer piston seal liner 95;
4. conduction through displacer piston seal liner 95, which is typically a low thermal conductivity material, such as either Rulon® J (Rulon® J is an all-polymeric reinforced, dull gold colored PTFE compound that operates exceptionally well against soft mating surfaces such as 316 stainless steel, aluminum, mild steel, brass and other plastics) or PEEK (Polyetheretherketone (PEEK), also referred to as polyketones);
5. conduction through displacer piston seal housing 105;
6. conduction across a gas gap (not shown) between displacer piston seal housing 105 and main housing (heat rejection housing) 115; and
7. conduction through main housing 115 to heat rejection interface 120, which would typically be a heat pipe for a space cryocooler application.

The poor thermal path from the compression chamber to the heat sink decreases the thermodynamic efficiency of the cryocooler by increasing the temperature difference over which the thermodynamic cycle must operate. Analysis of the conventional art indicated an expected total thermal resistance from the compression chamber to the heat sink of approximately 0.5 K/W. Space cryocoolers typically impart on the order of 100 W of thermodynamic pressure-volume (PV) power to the gas in the compression chamber to create the desired refrigeration, and this heat must ultimately be rejected to the environment. For a typical 300 K heat sink, this poor thermal path would result in a corresponding compression chamber mean temperature of 300+0.5×100=350 K. Assuming a typical cold tip temperature of 70 K, the actual Carnot efficiency versus the "ideal" (zero thermal resistance) Carnot efficiency compares as follows:

$$\beta_{C,ideal} = \frac{Tc}{Th - Tc} = \frac{70}{300 - 70} = 0.304$$

$$\beta_{C,act} = \frac{Tc}{Th + dT - Tc} = \frac{70}{300 + 50 - 70} = 0.250$$

Thus, the maximum efficiency of the thermodynamic cycle is reduced percentage wise by 18%. Recognizing that the actual efficiency achieved by the cryocooler is only a fraction of the Carnot efficiency, and that the fractional efficiency realized decreases as the temperature difference Th−Tc increases because the internal losses (such as conduction from the warm end to the cold end) increases, it becomes evident that this poor thermal path results in an unacceptably poor thermodynamic efficiency.

With the advent of larger focal plane arrays and two-color IR systems, power demands on space cryocoolers are increasing. The generation of cryocoolers presently under development routinely requires 300 W of PV power to drive the thermodynamic cycle. Given the 0.5 K/W thermal resistance for the present art, the compact in-line approach shown in FIGS. 1 and 2 is impractical. The resulting compression chamber for nominal 300 K heat rejection interfaces would be 450 K, which would result in likely catastrophic failure due to seizure of the moving parts due to thermal expansion effects or delamination of bonded liners. Even if these problems could be addressed, consideration of the Carnot efficiency for the above 70 K test case (0.184; a 40% reduction from the ideal case) reveals that the conventional art is not suitable to these higher power designs. Furthermore, the problem is subject to runaway because the lower efficiency drives the need for higher input power to carry the refrigeration load, which in turn drives a larger temperature rise from the heat sink to the compression chamber.

Figure 4:
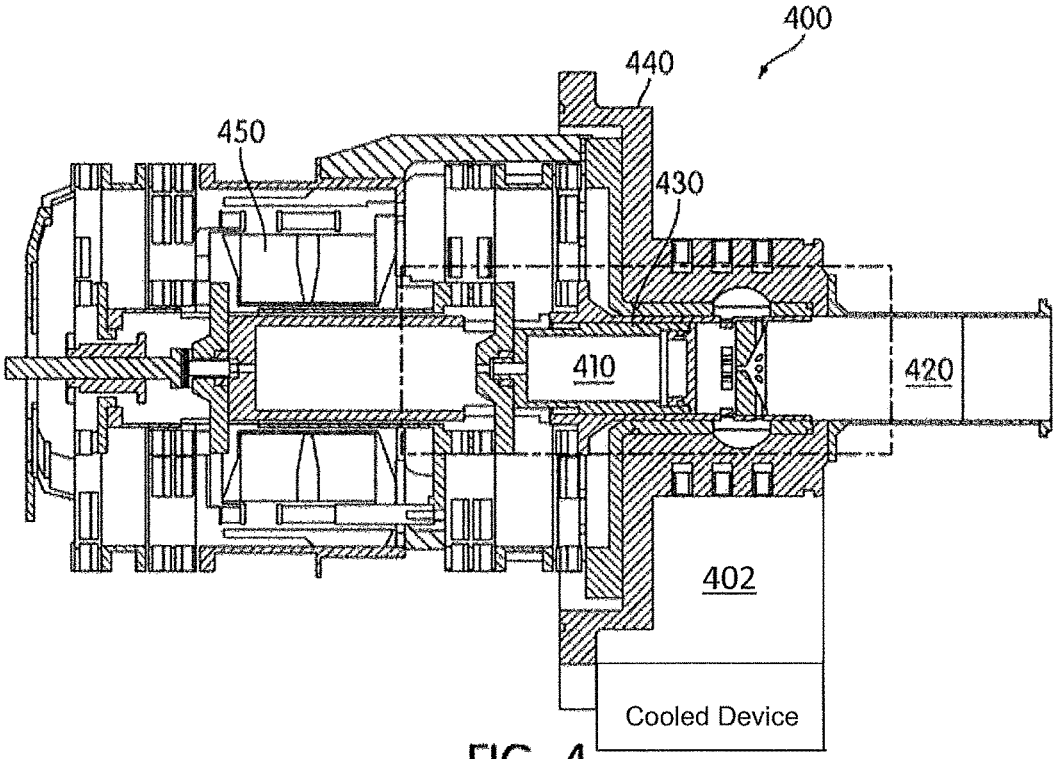
FIG. 4 shows a compact in-line cryocooler in accordance with an aspect of the disclosure.

FIG. 4 shows a compact in-line cryocooler in accordance with an aspect of the disclosure. In an aspect of the present disclosure, a more direct thermal path between the compression chamber and the heat sink is achieved. This thermal path includes: 1) convection between the gas in the heat exchanger passages to the main housing into which they are machined; and 2) conduction through the main housing to the heat rejection interface 402. In a space cryocooler application, the heat rejection interface would typically be a heat pipe 404.

As shown in FIG. 4, linear cryocooler 400 includes a compressor and a displacer inside a hermetically sealed housing. The compressor includes compressor piston 410. The displacer includes displacer piston 420. Both compressor piston 410 and displacer piston 420 are co-linearly arranged within compressor chamber 430 of housing 440. Movement of both compressor piston 410 and displacer piston 420 are controlled by motor 450. Under the separate forces delivered by the two separate and distinct windings of motor 450, the compressor piston 410 and displacer piston 420 move in a linear fashion, most generally out of phase with the displacer leading by nominally ninety degrees so that refrigeration is produced in the cold dynamic working volume. A regenerator (not shown) is coupled to the displacer, and moves with displacer piston 420. The regenerator is configured to absorb heat from a working fluid as it enters the 'hot' end of compressor chamber 430, and re-heats the fluid as it enters the 'cold' end of chamber 430.

Figure 5:
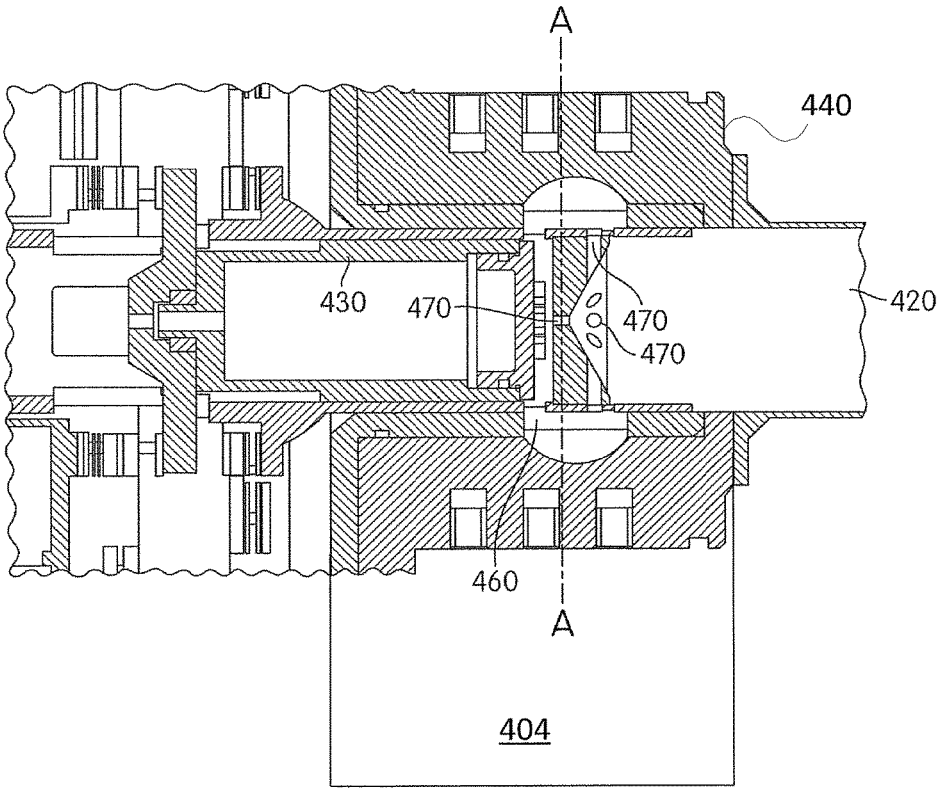
FIG. 5 shows the area enclosed in a dashed rectangle in FIG. 4 in greater detail.

FIG. 5 shows the area enclosed in a dashed rectangle in FIG. 4 in greater detail. As shown, walls of displacer piston 420 are arranged to have one or more openings or ports. In an aspect of the invention, compressor openings or ports 460 are arranged to transport gas(es) or heat between main housing 440 and compression chamber 430. Regenerator ports 470 are arranged to transport gas(es) or heat between main housing 440 and displacer piston inlet. Displacer piston 420 includes matching openings or holes to provide a gas flow path into the regenerator, which is housed within chamber 430.

Figure 6:
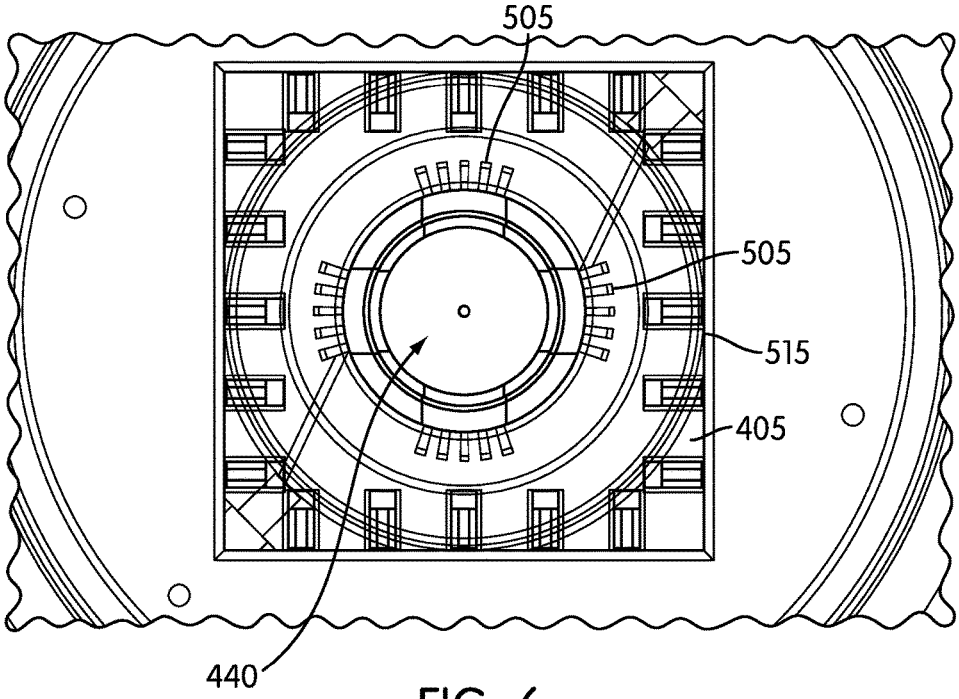
FIG. 6 shows a cross-sectional view of the cryocooler shown in FIG. 5.

FIG. 6 shows a cross sectional view of the linear cryocooler of FIG. 5. The cross section is taken along dashed line A-A in FIG. 5. As shown, one or more heat rejection heat exchangers 505 are incorporated directly into main housing 405. Heat exchangers 505 allow heat created by the compression of a working gas in chamber 440 to be removed through one or more ports 510 in the displacer piston and seal housing. The figure shows two sets of four heat exchangers, however, more or less can be used as would be apparent. The main housing 405 can be intimately sunk at 515 to the environmental temperature through heat pipes or heat straps (not shown). These heat pipes or heat straps can be directly mounted to the housing.

By using this more direct thermal path of the present disclosure, the tortuous thermal path of the conventional design can be overcome. Thermal analysis indicates a minimum 10× improvement in heat rejection, i.e., the expected thermal resistance in this heat rejection circuit for the present design is 0.05 K/W. For the nominal 70 K case with 100 W PV power used to assess the conventional design, the temperature rise from the heat sink to the compression chamber is 5 K, yielding a Carnot efficiency of 0.298 (comparing favorably to the theoretical maximum of 0.304). For the 300 W case, the compression chamber sits at 315 K for a 300 K rejection temperature as opposed to 450 K for the convention design.

Proper application of the present design requires consideration of the important underlying physics introduced or affected by the additional gas porting including pressure drop, void volume, and heat exchanger design.

The size of the gas ports and entrance and exit geometries must be properly designed to keep the pressure drop to an acceptably low level. For example, the presence of sharp edges and turns are to be minimized, and large flow areas are desirable. Interestingly, the pressure drop problem is in part mitigated by the present disclosure, in spite of the more tortuous physical gas flow path. By reducing the maximum cycle gas temperature through more effective heat rejection, the maximum velocity of the gas for a given mass flow rate is reduced due to the fact that the minimum density is reduced:

$$\rho = \frac{P}{RT}$$

$$u = \frac{\dot{m}}{\rho A_c},$$

where P is pressure, T is temperature, R is the gas constant, and $A_c$ is the cross sectional flow area at the point of interest. The first equation is the ideal gas equation of state, which is generally applicable for these types of cryocoolers, and the second equation is the definition of mass flow rate ($\dot{m}$) solved for velocity (u). Consideration of the governing fluid dynamics reveals that pressure drop is a strong function of velocity for either laminar or turbulent flows. Reducing the maximum temperature for a given pressure, mass flow rate and geometry thus helps reduce pressure drop.

The performance of a reciprocating cryocooler, of which the linear cryocooler is a subset, is in general adversely affected by the pressure of "void volume," which is defined in the art as working volume that is part of neither the dynamic compression nor expansion volumes. This is because this gas must be cycled along with the dynamic volumes, so larger piston swept volumes are required to achieve the same pressure ratio as the void volume increases. This results in a larger cryocooler to produce the same refrigeration and, to a lesser extent, a less efficient refrigeration system. Thus, the void volume introduced by the additional gas porting must be analyzed as a component in the overall cycle model to ensure that the impact is acceptable.

The number and size of the heat exchanger channels must be optimized for each design to properly balance the heat exchanger effectiveness with the aforementioned loss mechanisms. There are a number of competing design variables which must be carefully considered. For example, the heat exchanger effectiveness is improved with more surface area, but more surface area tends to indicate more void volume. As another example, the convective heat transfer coefficient improves with higher velocity in the flow channels, but high velocity also drives large pressure drops. Incorporation of all the important physics into a design model is thus required for proper implementation of the present disclosure.

Cycle analysis models indicate that even when these losses are considered, the present disclosure is expected to provide a 20% efficiency improvement over the conventional designs for low power (~100 W PV) applications. For high power applications (>200 W PV), the present disclosure is in fact deemed enabling.

Although the above disclosure discusses what is currently considered to be a variety of useful embodiments, it is to be understood that such detail is solely for that purpose, and that the appended claims are not limited to the disclosed embodiments, but, on the contrary, is intended to cover modifications and equivalent arrangements that are within the spirit and scope of the appended claims.

What is being claimed:

1. A method of removing heat due to compression of a working gas from a linear cryocooler, the cryocooler including a sealed housing, a displacer including a displacer piston and a displacer cylinder, and a compressor all arranged within the housing, the compressor having a compressor piston that is movable within a compression chamber, the method comprising:

removing heat due to the compression of the working gas from the compression chamber into the housing through a port in the compression chamber by: allowing passage of the working gas from the compression chamber into an area adjacent to the housing by thermal convection prior to the working gas entering the displacer piston;

removing heat due to the compression of the working gas from the linear cryocooler directly through the housing; and removing heat through a gas port in a regenerator, wherein the regenerator is operatively connected to the displacer cylinder and movable with the displacer piston, and the gas port is configured to allow gas transport between the sealed housing and an inlet of the displacer piston.

2. The method according to claim 1, further comprising:

thermally conducting the removed heat through the housing to a heat rejection interface.

3. The method according to claim 2, wherein the heat rejection interface is a heat pipe.

4. The method according to claim 2, wherein:

removing heat by allowing the passage of the working gas from the compression chamber into the area adjacent to the housing comprises allowing, via the port in the compression chamber, the passage of the working gas directly from the compression chamber and directly into the area adjacent to the housing, and removing heat through the gas port in the regenerator comprises allowing, via the gas port in the regenerator, passage of the working gas directly from the area adjacent to the sealed housing directly into the inlet of the displacer piston.

5. The method according to claim 1, wherein the working gas is selected from a group consisting of helium, air and hydrogen.

6. A linear cryocooler, comprising:

a sealed housing configured to remove heat due to compression of a working gas from the linear cryocooler and to house a compressor and a displacer having a displacer piston operable to move within a displacer cylinder, the compressor including a compressor piston that is movable within a compression chamber, wherein the compression chamber includes a port configured to:

allow rejection of heat due to compression of the working gas by the compressor directly through the sealed housing, and allow passage of the working gas from the compression chamber directly into an area adjacent to the housing by thermal convection prior to the working gas entering the displacer piston; and a regenerator operatively connected to the displacer cylinder and movable with the displacer piston, the regenerator including a gas port that is configured to allow gas transport between the sealed housing and an inlet of the displacer piston.

7. The linear cryocooler according to claim 6, wherein:

the port in the compression chamber is configured to allow the passage of the working gas directly from the compression chamber and directly into the area adjacent to the housing, and the gas port in the regenerator is configured to allow passage of the working gas directly from the area adjacent to the sealed housing directly into the inlet of the displacer piston.

8. The linear cryocooler according to claim 7, further comprising:

a heat rejection interface operatively coupled to the housing, the heat rejection interface configured to receive at least a portion of the rejected heat from the housing through thermal conduction.

9. The linear cryocooler according to claim 8, wherein the heat rejection interface is a heat pipe.

10. The linear cryocooler according to claim 6, wherein the working gas is selected from a group consisting of helium, air and hydrogen.

11. The linear cryocooler according to claim 6, wherein the port is arranged between the housing and the compressor.

12. The linear cryocooler according to claim 6, wherein the port is arranged between the housing and the inlet of the displacer piston.

13. A system comprising:

a linear cryocooler comprising:

a sealed housing configured to remove heat due to compression of a working gas from the linear cryocooler and to house a compressor and a displacer having a displacer piston operable to move within a displacer cylinder, the compressor including a compressor piston that is movable within a compression chamber, wherein the compression chamber includes a port, wherein the port is configured to:

allow rejection of heat due to compression of the working gas by the compressor directly through the sealed housing, and allow passage of the working gas from the compression chamber directly into an area adjacent to the housing by thermal convection prior to the working gas entering the displacer piston; and a regenerator operatively connected to the displacer cylinder and movable with the displacer piston, the regenerator including a gas port that is configured to allow gas transport between the sealed housing and an inlet of the displacer piston; and at least one of a sensor and an optical component, wherein the at least one of the sensor and the optical component is configured to be cooled by the linear cryocooler.

14. The system according to claim 13, wherein:

the port in the compression chamber is configured to allow the passage of the working gas directly from the compression chamber and directly into the area adjacent to the housing, and the gas port in the regenerator is configured to allow passage of the working gas directly from the area adjacent to the sealed housing directly into the inlet of the displacer piston.

15. The system according to claim 13, wherein the linear cryocooler further comprises:

a heat rejection interface operatively coupled to the housing, the heat rejection interface configured to conduct the rejected heat through the housing.

16. The system according to claim 15, wherein the heat rejection interface is a heat pipe.

17. The system according to claim 13, wherein the port is arranged between a pore of the housing and the compressor.

18. The system according to claim 13, wherein the port is configured to allow passage of the working gas between the housing and the inlet of the displacer piston.

19. The method according to claim 1, wherein the port is between the compression chamber and a pore of the housing; and the method further comprises:

porting the heated working gas from the compression chamber through the port directly into the pore of the housing by thermal convection.

20. The linear cryocooler according to claim 6, wherein the port is disposed between the compression chamber and a pore of the sealed housing and further configured to allow passage of the working gas directly from the compression chamber to the pore of the sealed housing.

* * * * *